US005114438A

United States Patent [19]

Leatherman et al.

[11] Patent Number: 5,114,438

[45] Date of Patent: May 19, 1992

[54] ABRASIVE ARTICLE

[75] Inventors: Dennis D. Leatherman; James J. McGinley, both of Pittsburgh, Pa.; Daniel E. Adams, Barrington, Ill.; George A. Brons, Lincroft, N.J.

[73] Assignee: PPG Industries, Inc., Pittsburgh, Pa.

[21] Appl. No.: 605,283

[22] Filed: Oct. 29, 1990

[51] Int. Cl.[5] ..... B24B 1/00

[52] U.S. Cl. ..... 51/296; 51/308

[58] Field of Search ..... 51/296, 308

[56] References Cited

U.S. PATENT DOCUMENTS

| | | | |
|---|---|---|---|
| 3,029,209 | 4/1962 | Ferrigno | 51/298 |
| 3,252,775 | 5/1966 | Tocci-Guilbert | 51/298 |
| 3,918,220 | 11/1975 | Jury et al. | 51/296 |
| 4,038,047 | 7/1977 | Haywood | 51/296 |
| 4,138,228 | 2/1979 | Hartfelt et al. | 51/295 |
| 4,708,891 | 11/1987 | Ito et al. | 427/245 |
| 4,750,915 | 6/1988 | Tomita et al. | 51/308 |
| 4,775,501 | 10/1988 | Rosenweig et al. | 156/49 |
| 4,828,772 | 5/1989 | Lopatin et al. | 264/51 |
| 4,833,172 | 5/1989 | Schwartz et al. | 264/49 |
| 4,842,619 | 6/1989 | Fritz et al. | 51/293 |
| 4,861,644 | 8/1989 | Young et al. | 427/256 |
| 4,904,280 | 2/1990 | Cygan et al. | 51/296 |

FOREIGN PATENT DOCUMENTS

| | | |
|---|---|---|
| 1146666 | 6/1989 | Japan . |
| 2-67389 | 3/1990 | Japan . |

OTHER PUBLICATIONS

Encyclopedia of Chemical Technology, Kirk-Othmer, Third Edition, vol. 1, A to Alkanolamines, pp. 26-52.

Encyclopedia of Polymer Science and Engineering, vol. 1, A to Amorphous Polymers, pp. 36-41.

The New Encyclopedia Britannica, vol. 1, 15th Edition, pp. 13-18.

Micro-Mesh Cushioned Abrasives, Micro-Surface Finishing Products, Inc.

*Primary Examiner*—Dixon, Jr. William R.
*Assistant Examiner*—Sue Hollenbeck
*Attorney, Agent, or Firm*—George D. Morris

[57] ABSTRACT

An abrasive article comprises abrasive particles bonded to microporous material wherein the microporous material comprises (a) a matrix consisting essentially of thermoplastic organic polymer, (b) a large proportion of finely divided water-insoluble siliceous filler, and (c) a large void volume.

31 Claims, No Drawings

ABRASIVE ARTICLE

The present invention is directed to an abrasive article comprising abrasive particles bonded to microporous material wherein the microporous material comprises a large proportion of siliceous particles and a large void volume.

Accordingly, in an abrasive article wherein abrasive particles are bonded to a backing, one embodiment is the improvement wherein the backing is microporous material which on a coating-free, printing ink-free, and impregnant-free basis comprises: (a) a matrix consisting essentially of substantially water insoluble thermoplastic organic polymer, (b) finely divided substantially water-insoluble filler particles, of which at least about 50 percent by weight are siliceous particles, the filler particles being distributed throughout the matrix and constituting from about 40 to about 90 percent by weight of the microporous material, and (c) a network of interconnecting pores communicating substantially throughout the microporous material, the pores constituting from about 35 to about 80 percent by volume of the microporous material.

Another embodiment of the invention is an abrasive article comprising: (a) at least one sheet of microporous material having generally opposing sides, the microporous material on a coating-free, printing ink-free, and impregnant-free basis comprising: (1) a matrix consisting essentially of substantially water insoluble thermoplastic organic polymer, (2) finely divided substantially water-insoluble filler particles, of which at least about 50 percent by weight are siliceous particles, the filler particles being distributed throughout the matrix and constituting from about 40 to about 90 percent by weight of the microporous material, (3) a network of interconnecting pores communicating substantially throughout the microporous material, the pores constituting from about 35 to about 80 percent by volume of the microporous material; and (b) abrasive particles bonded to at least a portion of at least one side of the sheet of microporous material.

In the method wherein adhesive particles are bonded to a backing, yet another embodiment of the invention is the improvement wherein the backing is microporous material comprising on a coating-free, printing ink-free, and impregnant-free basis: (a) a matrix consisting essentially of substantially water insoluble thermoplastic organic polymer, (b) finely divided substantially water-insoluble filler particles, of which at least about 50 percent by weight are siliceous particles, the filler particles being distributed throughout the matrix and constituting from about 40 to about 90 percent by weight of the microporous material, and (c) a network of interconnecting pores communicating substantially throughout the microporous material, the pores constituting from about 35 to about 80 percent by volume of the microporous material.

There are many advantages in using the microporous material described herein as a backing for abrasives.

One such advantage is that due to the high abrasion resistance, high siliceous particle content, and microporous structure, the microporous material allows for a cushioning effect which enhances the abrading action of the abrasive particles.

The microporous material is also waterproof so that when the abrasive particles and the adhesive used to bond the abrasive particles to the backing are waterproof, the abrasive article can be very effectively used in abrading operations conducted in the presence of water. Water is useful as a coolant and for removing abraded material and abrasive powder from the region where abrasion is taking place.

The microporous material is also inert to most oils at temperatures below about 100° C., so that when the abrasive particles and the adhesive used to bond the abrasive particles to the backing are also inert to oil, the abrasive article can be very effectively used in abrading operations conducted in the presence of oil. Oil is useful as a coolant and for removing abraded material and abrasive powder from the region where abrasion is taking place.

Another advantage is that the microporous material backings accept a wide variety of coatings and printing inks, including most organic solvent-based coatings and inks which are incompatible with water, organic solvent-based coatings and inks which are compatible with water, and water-based coatings and inks.

Yet another advantage is very rapid drying of most printing inks to the tack-free stage upon printing the microporous material backings. This advantage is quite important in high speed press runs, in multicolor printing, and in reducing or even eliminating blocking of stacks or coils of the printed backing.

A further advantage is the sharpness of the printed image that can be attained.

Many known microporous materials may be employed in the present invention. Examples of such microporous materials are described in U.S. Pat. Nos. 2,772,322; 3,351,495; 3,696,061; 3,725,520; 3,862,030; 3,903,234; 3,967,978; 4,024,323; 4,102,746; 4,169,014; 4,210,709; 4,226,926; 4,237,083; 4,335,193; 4,350,655; 4,472,328; 4,585,604; 4,613,643; 4,681,750; 4,791,144; 4,833,172; and 4,861,644; 4,892,779; and 4,927,802, the disclosures of which are, in their entireties, incorporated herein by reference.

The matrix of the microporous material consists essentially of substantially water-insoluble thermoplastic organic polymer. The numbers and kinds of such polymers suitable for use of the matrix are enormous. In general, substantially any substantially water-insoluble thermoplastic organic polymer which can be extruded, calendered, pressed, or rolled into film, sheet, strip, or web may be used. The polymer may be a single polymer or it may be a mixture of polymers. The polymers may be homopolymers, copolymers, random copolymers, block copolymers, graft copolymers, atactic polymers, isotactic polymers, syndiotactic polymers, linear polymers, or branched polymers. When mixtures of polymers are used, the mixture may be homogeneous or it may comprise two or more polymeric phases. Examples of classes of suitable substantially water-insoluble thermoplastic organic polymers include the thermoplastic polyolefins, poly(halo-substituted olefins), polyesters, polyamides, polyurethanes, polyureas, poly(vinyl halides), poly(vinylidene halides), polystyrenes, poly(vinyl esters), polycarbonates, polyethers, polysulfides, polyimides, polysilanes, polysiloxanes, polycaprolactones, polyacrylates, and polymethacrylates. Hybrid classes exemplified by the thermoplastic poly(urethane-ureas), poly(ester-amides), poly(silane-siloxanes), and poly(ether-esters) are within contemplation. Examples of suitable substantially water-insoluble thermoplastic organic polymers include thermoplastic high density polyethylene, low density polyethylene, ultrahigh molecular weight polyethylene, polypropylene (atactic, isotactic, or syndiotatic as the case may be), poly(vinyl chloride), polytetrafluoroethylene, copolymers of ethylene and acrylic acid, copolymers of ethylene and methacrylic acid, poly(vinylidene chloride), copolymers of vinylidene chloride and vinyl acetate, copolymers of vinylidene chloride and vinyl chloride, copolymers of ethylene and propylene, copolymers of ethylene and butene, poly(vinyl acetate), polystyrene, poly(omega-aminoundecanoic acid) poly(hexamethylene adipamide), poly(epsilon-caprolactam), and poly(-methyl methacrylate). These listings are by no means exhaustive, but are intended for purposes of illustration. The preferred substantially water-insoluble thermoplastic organic polymers comprise poly(vinyl chloride), copolymers of vinyl chloride, or mixtures thereof; or they comprise essentially linear ultrahigh molecular weight polyolefin which is essentially linear ultrahigh molecular weight polyethylene having an intrinsic viscosity of at least about 10 deciliters/gram, essentially linear ultrahigh molecular weight polypropylene having an intrinsic viscosity of at least about 6 deciliters/-gram, or a mixture thereof. Essentially linear ultrahigh molecular weight polyethylene having an intrinsic viscosity of at least about 18 deciliters/gram is especially preferred.

Inasmuch as ultrahigh molecular weight (UHMW) polyolefin is not a thermoset polymer having an infinite molecular weight, it is technically classified as a thermoplastic. However, because the molecules are essentially very long chains, UHMW polyolefin, and especially UHMW polyethylene, softens when heated but does not flow as a molten liquid in a normal thermoplastic manner. The very long chains and the peculiar properties they provide to UHMW polyolefin are believed to contribute in large measure to the desirable properties of microporous materials made using this polymer.

As indicated earlier, the intrinsic viscosity of the UHMW polyethylene is at least about 10 deciliters/-gram. Usually the intrinsic viscosity is at least about 14 deciliters/gram. Often the intrinsic viscosity is at least about 18 deciliters/gram. In many cases the intrinsic viscosity is at least about 19 deciliters/gram. Although there is no particular restriction on the upper limit of the intrinsic viscosity, the intrinsic viscosity is frequently in the range of from about 10 to about 39 deciliters/gram. The intrinsic viscosity is often in the range of from about 14 to about 39 deciliters/gram. In most cases the intrinsic viscosity is in the range of from about 18 to about 39 deciliters/gram. An intrinsic viscosity in the range of from about 18 to about 32 deciliters/gram is preferred.

Also as indicated earlier the intrinsic viscosity of the UHMW polypropylene is at least about 6 deciliters/-gram. In many cases the intrinsic viscosity is at least about 7 deciliters/gram. Although there is no particular restriction on the upper limit of the intrinsic viscosity, the intrinsic viscosity is often in the range of from about 6 to about 18 deciliters/gram. An intrinsic viscosity in the range of from about 7 to about 16 deciliters/gram is preferred.

As used herein and in the claims, intrinsic viscosity is determined by extrapolating to zero concentration the reduced viscosities or the inherent viscosities of several dilute solutions of the UHMW polyolefin where the solvent is freshly distilled decahydronaphthalene to which 0.2 percent by weight, 3,5-di-tert-butyl-4-hydroxyhydrocinnamic acid, neopentanetetrayl ester [CAS Registry No. 6683-19-8] has been added. The reduced viscosities or the inherent viscosities of the UHMW polyolefin are ascertained from relative viscosities obtained at 135° C. using an Ubbelohde No. 1 viscometer in accordance with the general procedures of ASTM D 4020-81, except that several dilute solutions of differing concentration are employed. ASTM D 4020-81 is, in its entirety, incorporated herein by reference.

The nominal molecular weight of UHMW polyethylene is empirically related to the intrinsic viscosity of the polymer according to the equation:

$$M = 5.37 \times 10^4 [\eta]^{1.37}$$

where M is the nominal molecular weight and $[\eta]$ is the intrinsic viscosity of the UHMW polyethylene expressed in deciliters/gram. Similarly, the nominal molecular weight of UHMW polypropylene is empirically related to the intrinsic viscosity of the polymer according to the equation:

$$M = 8.88 \times 10^4 [\eta]^{1.25}$$

where M is the nominal molecular weight and $[\eta]$ is the intrinsic viscosity of the UHMW polypropylene expressed in deciliters/gram.

The essentially linear ultrahigh molecular weight polypropylene is most frequently essentially linear ultrahigh molecular weight isotactic polypropylene. Often the degree of isotacicity of such polymer is at least about 95 percent, while preferably it is at least about 98 percent.

When used, sufficient UHMW polyolefin should be present in the matrix to provide its properties to the microporous material. Other thermoplastic organic polymer may also be present in the matrix so long as its presence does not materially affect the properties of the microporous material in an adverse manner. The amount of the other thermoplastic polymer which may be present depends upon the nature of such polymer. In general, a greater amount of other thermoplastic organic polymer may be used if the molecular structure contains little branching, few long sidechains, and few bulky side groups, than when there is a large amount of branching, many long sidechains, or many bulky side groups. For this reason, the preferred thermoplastic organic polymers which may optionally be present are low density polyethylene, high density polyethylene, poly(tetrafluoroethylene), polypropylene, copolymers of ethylene and propylene, copolymers of ethylene and acrylic acid, and copolymers of ethylene and methacrylic acid. If desired, all or a portion of the carboxyl groups of carboxyl-containing copolymers may be neutralized with sodium, zinc, or the like. It is our experience that usually at least about one percent UHMW polyolefin, based on the weight of the matrix, will provide the desired properties to the microporous material. At least about 3 percent UHMW polyolefin by weight of the matrix is commonly used. In many cases at least about 10 percent by weight of the matrix is UHMW polyolefin. Frequently at least about 50 percent by weight of the matrix is UHMW polyolefin. In many instances at least about 60 percent by weight of the matrix is UHMW polyolefin. Often at least about 70 percent by weight of the matrix is UHMW polyolefin. In some cases the other thermoplastic organic polymer is substantially absent.

As present in the microporous material, the finely divided substantially water-insoluble siliceous particles may be in the form of ultimate particles, aggregates of ultimate particles, or a combination of both. In most cases, at least about 90 percent by weight of the siliceous particles used in preparing the microporous material have gross particle sizes in the range of from about 5 to about 40 micrometers as determined by use of a Model TAII Coulter counter (Coulter Electronics, Inc.) according to ASTM C 690-80 but modified by stirring the filler for 10 minutes in Isoton II electrolyte (Curtin Matheson Scientific, Inc.) using a four-blade, 4.445 centimeter diameter propeller stirrer. Preferably at least about 90 percent by weight of the siliceous particles have gross particle sizes in the range of from about 10 to about 30 micrometers. It is expected that the sizes of filler agglomerates may be reduced during processing of the ingredients to prepare the microporous material. Accordingly, the distribution of gross particle sizes in the microporous material may be smaller than in the raw siliceous filler itself. ASTM C 690-80 is, in its entirety, incorporated herein by reference.

Examples of suitable siliceous particles include particles of silica, mica, montmorillonite, kaolinite, asbestos, talc, diatomaceous earth, vermiculite, natural and synthetic zeolites, cement, calcium silicate, aluminum silicate, sodium aluminum silicate, aluminum polysilicate, alumina silica gels, and glass particles. Silica and the clays are the preferred siliceous particles. Of the silicas, precipitated silica, silica gel, or fumed silica is most often used.

In addition to the siliceous particles, finely divided substantially water-insoluble non-siliceous filler particles may also be employed. Examples of such optional non-siliceous filler particles include particles of titanium oxide, iron oxide, copper oxide, zinc oxide, antimony oxide, zirconia, magnesia, alumina, molybdenum disulfide, zinc sulfide, barium sulfate, strontium sulfate, calcium carbonate, magnesium carbonate, magnesium hydroxide, and finely divided substantially water-insoluble flame retardant filler particles such as particles of ethylenebis(tetra-bromophthalimide), octabromodiphenyl oxide, decabromodiphenyl oxide, and ethylenebisdibromonorbornane dicarboximide.

As present in the microporous material, the finely divided substantially water-insoluble non-siliceous filler particles may be in the form of ultimate particles, aggregates of ultimate particles, or a combination of both. In most cases, at least about 75 percent by weight of the non-siliceous filler particles used in preparing the microporous material have gross particle sizes in the range of from about 0.1 to about 40 micrometers as determined by use of a Micromeretics Sedigraph 5000-D (Micromeretics Instrument Corp.) in accordance with the accompanying operating manual. The preferred ranges vary from filler to filler. For example, it is preferred that at least about 75 percent by weight of antimony oxide particles be in the range of from about 0.1 to about 3 micrometers, whereas it is preferred that at least about 75 percent by weight of barium sulfate particles be in the range of from about 1 to about 25 micrometers. It is expected that the sizes of filler agglomerates may be reduced during processing of the ingredients to prepare the microporous material. Therefore, the distribution of gross particle sizes in the microporous material may be smaller than in the raw non-siliceous filler itself.

The particularly preferred finely divided substantially water-insoluble siliceous filler particles are precipitated silica. Although both are silicas, it is important to distinguish precipitated silica from silica gel inasmuch as these different materials have different properties. Reference in this regard is made to R. K. Iler, *The Chemistry of Silica*, John Wiley & Sons, New York (1979), Library of Congress Catalog No. QD 181.S6144, the entire disclosure of which is incorporate herein by reference. Note especially pages 15-29, 172-176, 218-233, 364-365, 462-465, 554-564, and 578-579. Silica gel is usually produced commercially at low pH by acidifying an aqueous solution of a soluble metal silicate, typically sodium silicate, with acid. The acid employed is generally a strong mineral acid such as sulfuric acid or hydrochloric acid although carbon dioxide is sometimes used. Inasmuch as there is essentially no difference in density between the gel phase and the surrounding liquid phase while the viscosity is low, the gel phase does not settle out, that is to say, it does not precipitate. Silica gel, then, may be described as a non-precipitated, coherent, rigid, three-dimensional network of contiguous particles of colloidal amorphous silica. The state of subdivision ranges from large, solid masses to submicroscopic particles, and the degree of hydration from almost anhydrous silica to soft gelatinous masses containing on the order of 100 parts of water per part of silica by weight, although the highly hydrated forms are only rarely used in the present invention.

Precipitated silica is usually produced commercially by combining an aqueous solution of a soluble metal silicate, ordinarily alkali metal silicate such as sodium silicate, and an acid so that colloidal particles will grow in weakly alkaline solution and be coagulated by the alkali metal ions of the resulting soluble alkali metal salt. Various acids may be used, including the mineral acids and carbon dioxide. In the absence of a coagulant, silica is not precipitated from solution at any pH. The coagulant used to effect precipitation may be the soluble alkali metal salt produced during formation of the colloidal silica particles, it may be added electrolyte such as a soluble inorganic or organic salt, or it may be a combination of both.

Precipitated silica, then, may be described as precipitated aggregates of ultimate particles of colloidal amorphous silica that have not at any point existed as macroscopic gel during the preparation. The sizes of the aggregates and the degree of hydration may vary widely.

Precipitated silica powders differ from silica gels that have been pulverized in ordinarily having a more open structure, that is, a higher specific pore volume. However, the specific surface area of precipitated silica as measured by the Brunauer, Emmet, Teller (BET) method using nitrogen as the adsorbate, is often lower than that of silica gel.

Many different precipitated silicas may be employed in the present invention, but the preferred precipitated silicas are those obtained by precipitation from an aqueous solution of sodium silicate sing a suitable acid such as sulfuric acid, hydrochloric acid, or carbon dioxide. Such precipitated silicas are themselves known and processes for producing them are described in detail in U.S. Pat. No. 2,940,830, in U.S. Pat. No. 4,681,750, the entire disclosures of which are incorporated herein by reference, including especially the processes for making precipitated silicas and the properties of the products.

In the case of the preferred filler, precipitated silica, the average ultimate particle size (irrespective of whether or not the ultimate particles are agglomerated) is less than about 0.1 micrometer as determined by transmission electron microscopy. Often the average ultimate particle size is less than about 0.05 micrometer. Preferably the average ultimate particle size of the precipitated silica is less than about 0.03 micrometer.

The finely divided substantially water-insoluble filler particles constitute from about 40 to about 90 percent by weight of the microporous material. Frequently such filler particles constitute from about 40 to about 85 percent by weight of the microporous material. Often the finely divided substantially water-insoluble filler particles constitute from about 50 to about 90 percent by weight of the microporous material. In many cases the finely divided substantially water-insoluble filler particles constitute from about 50 to about 85 percent by weight of the microporous material. From about 60 percent to about 80 percent by weight is preferred.

At least about 50 percent by weight of the finely divided substantially water-insoluble filler particles are finely divided substantially water-insoluble siliceous filler particles. In many cases at least about 65 percent by weight of the finely divided substantially water-insoluble filler particles are siliceous. Often at least about 75 percent by weight of the finely divided substantially water-insoluble filler particles are siliceous. Frequently at least about 85 percent by weight of the finely divided substantially water-insoluble filler particles are siliceous. In many instances all of the finely divided substantially water-insoluble filler particles are siliceous.

Minor amounts, usually less than about 5 percent by weight, of other materials used in processing such as lubricant, processing plasticizer, organic extraction liquid, surfactant, water, and the like, may optionally also be present. Yet other materials introduced for particular purposes may optionally be present in the microporous material in small amounts, usually less than about 15 percent by weight. Examples of such materials include antioxidants, ultraviolet light absorbers, reinforcing fibers such as chopped glass fiber strand, dyes, pigments, and the like. The balance of the microporous material, exclusive of filler and any coating, printing ink, or impregnant applied for one or more special purposes is essentially the thermoplastic organic polymer.

On a coating-free, printing ink free, impregnant-free, and pre-bonding basis, pores constitute from about 35 to about 80 percent by volume of the microporous material when made by the above-described process. In many cases the pores constitute from about 60 to about 75 percent by volume of the microporous material. As used herein and in the claims, the porosity (also known as void volume) of the microporous material, expressed as percent by volume, is determined according to the equation:

$$\text{Porosity} = 100[1 - d_1/d_2]$$

where $d_1$ is the density of the sample which is determined from the sample weight and the sample volume as ascertained from measurements of the sample dimensions and $d_2$ is the density of the solid portion of the sample which is determined from the sample weight and the volume of the solid portion of the sample. The volume of the solid portion of the same is determined using a Quantachrome stereopycnometer (Quantachrome Corp.) in accordance with the accompanying operating manual.

The volume average diameter of the pores of the microporous material is determined by mercury porosimetry using an Autoscan mercury porosimeter (Quantachrome Corp.) in accordance with the accompanying operating manual. The volume average pore radius for a single scan is automatically determined by the porosimeter. In operating the porosimeter, a scan is made in the high pressure range (from about 138 kilopascals absolute to about 227 megapascals absolute). If about 2 percent or less of the total intruded volume occurs at the low end (from about 138 to about 250 kilopascals absolute) of the high pressure range, the volume average pore diameter is taken as twice the volume average pore radius determined by the porosimeter. Otherwise, an additional scan is made in the low pressure range (from about 7 to about 165 kilopascals absolute) and the volume average pore diameter is calculated according to the equation:

$$d = 2\left(\frac{v_1 r_1}{w_1} + \frac{v_2 r_2}{w_2}\right) \Big/ \left(\frac{v_1}{w_1} + \frac{v_2}{w_2}\right)$$

where d is the volume average pore diameter, $v_1$ is the total volume of mercury intruded in the high pressure range, $v_2$ is the total volume of mercury intruded in the low pressure range, $r_1$ is the volume average pore radius determined from the high pressure scan, $r_2$ is the volume average pore radius determined from the low pressure scan, $w_1$ is the weight of the sample subjected to the high pressure scan, and $w_2$ is the weight of the sample subjected to the low pressure scan. Generally on a coating-free, printing ink-free, impregnant-free, and pre-bonding basis the volume average diameter of the pores is in the range of from about 0.02 to about 0.5 micrometer. Very often the volume average diameter of the pores is in the range of from about 0.04 to about 0.3 micrometer. From about 0.05 to about 0.25 micrometer is preferred.

In the course of determining the volume average pore diameter by the above procedure, the maximum pore radius detected is sometimes noted. This is taken from the low pressure range scan if run; otherwise it is taken from the high pressure range scan. The maximum pore diameter is twice the maximum pore radius.

Inasmuch as some coating processes, printing processes, impregnation processes and bonding processes result in filling at least some of the pores of the microporous material and since some of these processes irreversibly compress the microporous material, the parameters in respect of porosity, volume average diameter of the pores, and maximum pore diameter are determined for the microporous material prior to application of one or more of these processes.

Microporous material may be produced according to the general principles and procedures of U.S. Pat. Nos. 3,351,495; 4,833,172; 4,892,779; 4,927,802; 4,937,115; and application Ser. No. 264,242, filed Oct. 28, 1988, the entire disclosures of which are incorporated herein by reference, including especially the processes for making microporous materials and the properties of the products.

Preferably filler particles, thermoplastic organic polymer powder, processing plasticizer and minor amounts of lubricant and antioxidant are mixed until a substantially uniform mixture is obtained. The weight ratio of filler to polymer powder employed in forming the mixture is essentially the same as that of the microporous material to be produced. The mixture, together with additional processing plasticizer, is introduced to the heated barrel of a screw extruder. Attached to the extruder is a sheeting die. A continuous sheet formed by the die is forwarded without drawing to a pair of heated calender rolls acting cooperatively to form continuous sheet of lesser thickness than the continuous sheet exiting from the die. The continuous sheet from the calender then passes to a first extraction zone where the processing plasticizer is substantially removed by extraction with an organic liquid which is a good solvent for the processing plasticizer, a poor solvent for the organic polymer, and more volatile than the processing plasticizer. Usually, but not necessarily, both the processing plasticizer and the organic extraction liquid are substantially immiscible with water. The continuous sheet then passes to a second extraction zone where the residual organic extraction liquid is substantially removed by steam and/or water. The continuous sheet is then passed through a forced air dryer for substantial removal of residual water and remaining residual organic extraction liquid. From the dryer the continuous sheet, which is microporous material, is passed to a take-up roll.

The processing plasticizer has little solvating effect on the thermoplastic organic polymer at 60° C., only a moderate solvating effect at elevated temperatures on the order of about 100° C., and a significant solvating effect at elevated temperatures on the order of about 200° C. It is a liquid at room temperature and usually it is processing oil such as paraffinic oil, naphthenic oil, or aromatic oil. Suitable processing oils include those meeting the requirements of ASTM D 2226-82, Types 103 and 104. Preferred are oils which have a pour point of less than 22° C. according to ASTM D 97-66 (reapproved 1978). Particularly preferred are oils having a pour point of less than 10° C. Examples of suitable oils include Shellflex® 412 and Shellflex® 371 oil (Shell Oil Co.) which are solvent refined and hydrotreated oils derived from naphthenic crude. Further examples of suitable oils include ARCOprime® 400 oil (Atlantic Richfield Co.) and Kaydol® oil (Witco Corp.) which are white mineral oils. ASTM D 2226-82 and ASTM D 97-66 (reapproved 1978) are, in their entireties, incorporated herein by reference. It is expected that other materials, including the phthalate ester plasticizers such as dibutyl phthalate, bis(2-ethylhexyl) phthalate, diisodecyl phthalate, dicyclohexyl phthalate, butyl benzyl phthalate, and ditridecyl phthalate will function satisfactorily as processing plasticizers.

There are many organic extraction liquids that can be used. Examples of suitable organic extraction liquids include 1,1,2-trichloroethylene, perchloroethylene, 1,2-dichloroethane, 1,1,1-trichloroethane, 1,1,2-trichloroethane, methylene chloride, chloroform, 1,1,2-trichloro-1,2,2-trifluoroethane, isopropyl alcohol, diethyl ether, acetone, hexane, heptane, and toluene.

In the above described process for producing microporous material, extrusion and calendering are facilitated when the substantially water-insoluble filler particles carry much of the processing plasticizer. The capacity of the filler particles to absorb and hold the processing plasticizer is a function of the surface area of the filler. It is therefore preferred that the filler have a high surface area. High surface area fillers are materials of very small particle size, materials having a high degree of porosity or materials exhibiting both characteristics. Usually the surface area of at least the siliceous filler particles is in the range of from about 20 to about 400 square meters per gram as determined by the Brunauer, Emmett, Teller (BET) method according to ASTM C 819-77 using nitrogen as the adsorbate but modified by outgassing the system and the sample for one hour at 130° C. Preferably the surface area is in the range of from about 25 to 350 square meters per gram. ASTM C 819-77 is, in its entirety, incorporated herein by reference. Preferably, but not necessarily, the surface area of any non-siliceous filler particles used is also in at least one of these ranges.

Inasmuch as it is desirable to essentially retain the filler in the microporous material, it is preferred that the substantially water-insoluble filler particles be substantially insoluble in the processing plasticizer and substantially insoluble in the organic extraction liquid when microporous material is produced by the above process.

The residual processing plasticizer content is usually less than 10 percent by weight of the microporous sheet and this may be reduced even further by additional extractions using the same or a different organic extraction liquid. Often the residual processing plasticizer content is less than 5 percent by weight of the microporous sheet and this may be reduced even further by additional extractions.

Microporous material may also be produced according to the general principles and procedures of U.S. Pat. Nos. 2,772,322; 3,696,061; and/or 3,862,030, the entire disclosures of which are incorporated herein by reference, including especially the processes for making microporous materials and the properties of the products. These principles and procedures are particularly applicable where the polymer of the matrix is or is predominately poly(vinyl chloride) or a copolymer containing a large proportion of polymerized vinyl chloride.

The abrasive particles which are bonded to the microporous material are themselves well known. Examples include naturally occurring abrasives such as corundum, garnet, quartz, flint, emery, and diamond. Examples of synthetic abrasives include aluminum oxide, alumina zirconia, silicon carbide, cubic boron nitride, synthetic diamond, crocus, and rouge.

The abrasive article is prepared by bonding abrasive particles to the microporous material. This is often accomplished by applying a layer of adhesive (called the "make coat") to the microporous material, applying adhesive particles to the make coat either mechanically or electrostatically, and hardening the make coat. Usually, but not necessarily, the make coat is partially or substantially wholly hardened after application of the abrasive particles and then one or more coatings of adhesive (called "size coats") are applied. The adhesive of the size coat may be the same as that of the make coat or it may be different. When multiple size coats are employed, each size coat may be partially or substantially wholly hardened prior to application of the next size coat. Following application of the last size coat, it and any unhardened or partially hardened coats are substantially wholly hardened. A wide variety of finishing operations such as cutting, winding, and/or flexing may be used when desired.

Many adhesives which are well known may be used to accomplish bonding. Examples of suitable classes of adhesives include thermosetting adhesives, thermoplastic adhesive, adhesives which form the bond by solvent evaporation, adhesives which form the bond by evaporation of liquid nonsolvent, and pressure sensitive adhesives. Examples of suitable adhesives include hide glue, phenolic resin, air-drying varnishes, aminoplast resins, epoxy resins, and polyurethane resins.

Abrasives and the production of coated abrasive products are discussed in *Kirk-Othmer Encyclopedia of Chemical Technology*, Third Edition, Volume 1, John Wiley & Sons, New York, (1978), pages 26-52, and in *Encyclopedia of Polymer Science and Engineering*, Volume 1, John Wiley & Sons, New York, (1985), pages 36-41, the disclosures of which are, in their entireties, incorporated herein by reference.

Microporous material backing may optionally be coated, impregnated, and/or printed with a wide variety of coating compositions, impregnating compositions, and/or printing inks using a wide variety of coating, impregnating, and/or printing processes. The coating compositions, coating processes, impregnating compositions, impregnation processes, printing inks, and printing processes are themselves conventional. The printing, impregnation, and coating of microporous material are more fully described in U.S. Pat. No. 4,861,644 and in application Ser. No. 409,853, filed Sep. 20, 1989, the entire disclosures of which are incorporated herein by reference.

The side of the microporous material opposite that to which the abrasive particles are bonded, may be bonded to a wide variety of porous or nonporous materials. The resulting laminate may be flexible or it may be substantially rigid, depending upon the nature of the material to which the microporous material is bonded. The bonding of microporous material to porous and/or nonporous materials is discussed in more detail in U.S. Pat. Nos. 4,877,679 and 4,892,779 and in application Ser. No. 490,214, filed Mar. 8, 1990, the entire disclosures of which are incorporated herein by reference.

Inasmuch as the microporous material contains a large proportion of siliceous filler, unstretched or stretched fibers of the same, with or without abrasive particles bonded thereto, may be effectively used as dental floss. Fibers may be produced by extrusion and extraction in a manner similar to that of microporous material sheet or by fibrillation of microporous material sheet.

The invention is further described in conjunction with the following examples which are to be considered illustrative rather than limiting.

EXAMPLES 1-6

The preparation of microporous material is illustrated by the following seven descriptive examples. Processing oil was used as the processing plasticizer. Silica, polymer, lubricant, and antioxidant in the amounts specified in Table I were placed in a high intensity mixer and mixed at high speed for 6 minutes. The processing oil needed to formulate the batch was pumped into the mixer over a period of 12-18 minutes with high speed agitation. After completion of the processing oil addition a 6 minute high speed mix period was used to complete the distribution of the processing oil uniformly throughout the mixture.

TABLE I

| | Formulations | | | | | |
|---|---|---|---|---|---|---|
| Example | 1 | 2 | 3 | 4 | 5 | 6 |
| Ingredient | 24.04 | 17.24 | 19.50 | 13.61 | 19.50 | 30.39 |
| UHMWPE (1), kg | | | | | | |
| HDPE (2), kg | 0.00 | 6.80 | 7.71 | 13.61 | 7.71 | 0.00 |
| Precipitated Silica (3), kg | 59.87 | 59.87 | 68.04 | 68.04 | 40.82 | 45.36 |
| Lubricant (4), g | 300 | 600 | 680 | 680 | 2700 | 450 |
| Antioxidant (5) g | 300 | 0 | 0 | 0 | 0 | 0 |
| (6) g | 0 | 100 | 115 | 110 | 85 | 130 |
| Titanium Dioxide (7), g | 0 | 0 | 680 | 680 | 0 | 450 |
| Processing Oil (8), kg | | | | | | |
| in Batch | 91.63 | 91.63 | 0.00 | 0.00 | 61.1 | 0.00 |
| at Extruder | ~35.14 | ~35.14 | 0.00 | 0.00 | ~59.3 | 0.00 |
| Processing Oil (9), kg | | | | | | |
| in Batch | 0.00 | 0.00 | 101.38 | 101.38 | 0.00 | 73.48 |
| at Extruder | 0.00 | 0.00 | ~50.55 | ~61.22 | 0.00 | ~134.76 |
| Recycled Oil-Filled Trim (10), kg | 0.00 | 0.00 | 7.03 | 0.00 | 0.00 | 0.00 |

(1) UHMWPE = Ultrahigh Molecular Weight Polyethylene, Himont 1900, Himont, U.S.A., Inc.
(2) HDPE = High Density Polyethylene, Hostalen TM GM 6255, Hoechst Celanese Corp.
(3) HiSil ® SBG, PPG Industries, Inc.
(4) Petrac ®, CZ81, Desoto, Inc., Chemical Speciality Division
(5) Irganox ® B-215, Ciba-Geigy Corp.
(6) Irganox ® 1010, Ciba-Geigy Corp.
(7) TiPure ® R960, E. I. DuPont de Nemours & Co., Inc., Chemicals and Pigments Department.
(8) Shellflex ®, 371, Shell Chemical Co.
(9) ARCOprime ® 400, Lyondell Chemical Co., Division of Atlantic Richfield Co.
(10) Material trimmed from the edges of the calendered, oil-filled sheet was chopped to reduce the particle size to from about 6.3 to about 12.7 millimeters and added to the mixer with the dry ingredients.

The batch was then conveyed to a ribbon blender where usually it was mixed with up to two additional batches of the same composition. Material was fed from the ribbon blender to a twin screw extruder by a variable rate screw feeder. Additional processing oil was added via a metering pump into the feed throat of the extruder. The extruder mixed and melted the formulation and extruded it through a 76.2 centimeter ×0.3175 centimeter slot die. The extruded sheet was then calendered. A description of one type of calender that may be used may be found in the U.S. Pat. No. 4,734,229, the entire disclosure of which is incorporated herein by reference, including the structures of the devices and their modes of operation. Other calenders of different design may alternatively be used; such calenders and their modes of operation are well known in the art. The hot, calendered sheet was then passed around a chill roll to cool the sheet. The rough edges of the cooled calendered sheet were trimmed by rotary knives to the desired width.

The oil filled sheet was conveyed to the extractor unit where it was contacted by both liquid and vaporized 1,1,2-trichloroethylene (TCE). The sheet was transported over a series of rollers in a serpentine fashion to provide multiple, sequential vapor/liquid/vapor contacts. The extraction liquid in the sump was maintained at a temperature of 65°–88° C. Overflow from the sump of the TCE extractor was returned to a still which recovered the TCE and the processing oil for reuse in the process. The bulk of the TCE was extracted from the sheet by steam as the sheet was passed through a second extractor unit. A description of these types of extractors may be found in U.S. Pat. No. 4,648,417, the entire disclosure of which is incorporated herein by reference, including especially the structures of the devices and their modes of operation. The sheet was dried by radiant heat and convective air flow. The dried sheet was wound on cores to provide roll stock for further processing.

The microporous sheets were tested for various physical properties the results of which are shown in Table II. Breaking Factor and the associated Elongation were determined in accordance with ASTM D 882-83. Strip Tensile and associated Elongation were determined in accordance with ASTM D 828-60. ASTM D 882-83 and ASTM D 828-60 are, in their entireties, incorporated herein by reference.

Property values indicated by MD (machine direction) were obtained on samples whose major axis was oriented along the length of the sheet. TD (transverse direction; cross machine direction) properties were obtained from samples whose major axis was oriented across the sheet.

TABLE II

| Physical Properties of Microporous Sheet | | | | | | |
|---|---|---|---|---|---|---|
| Example | 1 | 2 | 3 | 4 | 5 | 6 |
| Thickness, mm | 0.267 | 0.255 | 0.207 | 0.471 | 0.203 | 0.381 |
| Weight, g/m² | | | 106.5 | 293.0 | 117.8 | |
| Breaking Factor, kN/m | | | | | | |
| MD | | 3.23 | 2.43 | 3.96 | 4.98 | 6.47 |
| TD | | 1.52 | 0.99 | 2.00 | 1.34 | 3.00 |
| Strip Tensile, kN/m | | | | | | |
| MD | 3.42 | | | | | |
| TD | 1.52 | | | | | |
| Elongation at Break, % | | | | | | |
| MD | 391 | 688 | 648 | 808 | 632 | 623 |
| TD | 448 | 704 | 605 | 970 | 635 | 917 |
| Processing Oil Content, wt % | 2.8 | 3.1 | 0.9 | 13.0 | | |
| Estimated Porosity, vol % | | | | | 69.6 | |

EXAMPLE 7

The bed of a CSD Laboratory Drawdown Machine, Model II (Consler Scientific Design, Inc.) was covered with a sheet of absorbent paper. A 21.58 centimeter by 27.94 centimeter sheet of microporous material prepared under the conditions of Example 4 was placed on the absorbent sheet. The top edge of the microporous sheet was affixed to the absorbent sheet with a strip of adhesive tape. A bead of Elmer's Glue-All adhesive (Borden, Inc.) was dispensed on top of the adhesive tape. The adhesive was metered onto the microporous sheet by drawing a number 20 wire wound drawdown rod (Consler Scientific Design, Inc.) from above the adhesive bead over the length of the sheet. The adhesive coated microporous sheet was then covered with an excess of Alundum ® SM-8 abrasive particles (Norton Abrasives, Inc.). After approximately 5 minutes, the loose abrasive particles which had not adhered were poured off the microporous sheet. After further drying in an oven at about 105° C. for about 10 minutes additional loose abrasive was removed by gently tapping the uncoated side of the microporous sheet. The resulting abrasive article in which abrasive particles were bonded to a backing of microporous material, was successfully used to sand wood.

Although the present invention has been described with reference to specific details of certain embodiments thereof, it is not intended that such details should be regarded as limitations upon the scope of the invention except insofar as they are included in the accompanying claims.

What is claimed is:

1. In an abrasive article wherein abrasive particles are bonded to a backing, the improvement wherein said backing is microporous material which on a coating-free, printing ink-free, and impregnant-free basis comprises:

(a) a matrix consisting essentially of substantially water insoluble thermoplastic organic polymer;

(b) finely divided substantially water-insoluble filler particles, of which at least about 50 percent by weight are siliceous particles, said filler particles being distributed throughout said matrix and constituting from about 40 to about 90 percent by weight of said microporous material; and (c) a network of interconnecting pores communicating substantially throughout said microporous material, the pores constituting from about 35 to about 80 percent by volume of said microporous material.

2. The abrasive article of claim 1 wherein said substantially water-insoluble thermoplastic organic polymer comprises essentially linear ultrahigh molecular weight polyolefin which is essentially linear ultrahigh molecular weight polyethylene having an intrinsic viscosity of at least about 10 deciliters/gram, essentially linear ultrahigh molecular weight polypropylene having an intrinsic viscosity of at least about 6 deciliters/gram, or a mixture thereof.

3. The abrasive article of claim 2 wherein said essentially linear ultrahigh molecular weight polyolefin is essentially linear ultrahigh molecular weight polyethylene having an intrinsic viscosity of at least about 18 deciliters/gram.

4. The abrasive article of claim 3 wherein said pores on a coating-free, printing ink-free, impregnant-free, and pre-bonding basis constitute at from about 60 to about 75 percent by volume of said microporous material.

5. The abrasive article of claim 3 wherein said ultrahigh molecular weight polyethylene has an intrinsic viscosity in the range of from about 18 to about 39 deciliters/gram.

6. The abrasive article of claim 3 wherein said filler particles constitute from about 40 percent to about 85 percent by weight of said microporous material.

7. The abrasive article of claim 3 wherein said siliceous particles of said microporous material are silica particles.

8. The abrasive article of claim 3 wherein said siliceous particles of said microporous material are precipitated silica particles.

9. The abrasive article of claim 3 wherein on a coating-free, printing ink-free, impregnant-free, and pre-bonding basis the volume average diameter of said pores as determined by mercury porosimetry is in the range of from about 0.02 to about 0.5 micrometer.

10. The abrasive article of claim 3 wherein high density polyethylene is present in said matrix.

11. An abrasive article comprising:

(a) at least one sheet of microporous material having generally opposing sides, said microporous material on a coating-free, printing ink-free, and impregnant-free basis comprising:

(1) a matrix consisting essentially of substantially water insoluble thermoplastic organic polymer, (2) finely divided substantially water-insoluble filler particles, of which at least about 50 percent by weight are siliceous particles, said filler particles being distributed throughout said matrix and constituting from about 40 to about 90 percent by weight of said microporous material, (3) a network of interconnecting pores communicating substantially throughout said microporous material, the pores constituting from about 35 to about 80 percent by volume of said microporous material; and (b) abrasive particles bonded to at least a portion of at least one side of said sheet of microporous material.

12. The abrasive article of claim 11 wherein said abrasive particles are bonded to at least a portion of one side of said sheet of microporous material.

13. The abrasive article of claim 11 wherein said substantially water-insoluble thermoplastic organic polymer comprises essentially linear ultrahigh molecular weight polyolefin which is essentially linear ultrahigh molecular weight polyethylene having an intrinsic viscosity of at least about 10 deciliters/gram, essentially linear ultrahigh molecular weight polypropylene having an intrinsic viscosity of at least about 6 deciliters/gram, or a mixture thereof.

14. The abrasive article of claim 13 wherein said essentially linear ultrahigh molecular weight polyolefin is essentially linear ultrahigh molecular weight polyethylene having an intrinsic viscosity of at least about 18 deciliters/gram.

15. The abrasive article of claim 14 wherein said pores on a coating-free, printing ink-free, impregnant-free, and pre-bonding basis constitute at from about 60 to about 75 percent by volume of said microporous material.

16. The abrasive article of claim 14 wherein said ultrahigh molecular weight polyethylene has an intrinsic viscosity in the range of from about 18 to about 39 deciliters/gram.

17. The abrasive article of claim 14 wherein said filler particles constitute from about 40 percent to about 85 percent by weight of said microporous material.

18. The abrasive article of claim 14 wherein said siliceous particles of said microporous material are silica.

19. The abrasive article of claim 14 wherein said siliceous particles of said microporous material are precipitated silica particles.

20. The abrasive article of claim 14 wherein on a coating-free, printing ink-free, impregnant-free, and pre-bonding basis the volume average diameter of said pores as determined by mercury porosimetry is in the range of from about 0.02 to about 0.5 micrometer.

21. The abrasive article of claim 14 wherein high density polyethylene is present in said matrix.

22. In the method wherein adhesive particles are bonded to a backing, the improvement wherein said backing is microporous material comprising on a coating-free, printing ink-free, and impregnant-free basis:

(a) a matrix consisting essentially of substantially water insoluble thermoplastic organic polymer;

(b) finely divided substantially water-insoluble filler particles, of which at least about 50 percent by weight are siliceous particles, said filler particles being distributed throughout said matrix and constituting from about 40 to about 90 percent by weight of said microporous material; and (c) a network of interconnecting pores communicating substantially throughout said microporous material, said pores constituting from about 35 to about 80 percent by volume of said microporous material.

23. The method of claim 22 wherein said substantially water-insoluble thermoplastic organic polymer comprises essentially linear ultrahigh molecular weight polyolefin which is essentially linear ultrahigh molecular weight polyethylene having an intrinsic viscosity of at least about 10 deciliters/gram, essentially linear ultrahigh molecular weight polypropylene having an intrinsic viscosity of at least about 6 deciliters/gram, or a mixture thereof.

24. The method of claim 23 wherein said essentially linear ultrahigh molecular weight polyolefin is essentially linear ultrahigh molecular weight polyethylene having an intrinsic viscosity of at least about 18 deciliters/gram.

25. The method of claim 24 wherein said pores on a coating-free, printing ink-free, impregnant-free, and pre-bonding basis constitute at from about 60 to about 75 percent by volume of said microporous material.

26. The method of claim 24 wherein said ultrahigh molecular weight polyethylene has an intrinsic viscosity in the range of from about 18 to about 39 deciliters/gram.

27. The method of claim 24 wherein said filler particles constitute from about 40 percent to about 85 percent by weight of said microporous material.

28. The method of claim 24 wherein said siliceous particles of said microporous material are silica.

29. The method of claim 24 wherein said siliceous particles of said microporous material are precipitated silica particles.

30. The method of claim 24 wherein on a coating-free, printing ink-free, impregnant-free, and pre-bonding basis the volume average diameter of said pores as determined by mercury porosimetry is in the range of from about 0.02 to about 0.5 micrometer.

31. The method of claim 24 wherein high density polyethylene is present in said matrix.

* * * * *